US008331830B2

(12) United States Patent
Yoshihara

(10) Patent No.: US 8,331,830 B2
(45) Date of Patent: Dec. 11, 2012

(54) POWDER TRANSPORTING UNIT AND IMAGE FORMING APPARATUS USING THE SAME

(75) Inventor: Koutarou Yoshihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

(21) Appl. No.: 12/875,493

(22) Filed: Sep. 3, 2010

(65) Prior Publication Data

US 2011/0222914 A1 Sep. 15, 2011

(30) Foreign Application Priority Data

Mar. 12, 2010 (JP) ..... 2010-056168

(51) Int. Cl.
*G03G 15/00* (2006.01)
*G03G 15/04* (2006.01)
*G03G 15/08* (2006.01)

(52) U.S. Cl. ..... 399/258; 399/110; 399/119

(58) Field of Classification Search ..... 399/110, 399/119, 120, 258, 260, 262, 263
See application file for complete search history.

(56) References Cited

U.S. PATENT DOCUMENTS

2007/0077101 A1* 4/2007 Tamura et al. ..... 399/262
2008/0260431 A1* 10/2008 Saito ..... 399/256

FOREIGN PATENT DOCUMENTS

JP 2006-301604 A 11/2006
JP 2008-46190 A 2/2008
JP 2009-265514 A 11/2009

* cited by examiner

*Primary Examiner* — Joseph S Wong
(74) *Attorney, Agent, or Firm* — Sughrue Mion, PLLC

(57) ABSTRACT

According to an aspect of the invention, a powder transporting unit include: a first powder transporting cylindrical member in which a powder reception port for receiving a powder from a powder storage container storing the powder is opened in an upper portion of the first powder transporting cylindrical member; a second powder transporting cylindrical member whose inner diameter is formed to be larger than an inner diameter of the first powder transporting cylindrical member and in which a powder discharge port for discharging the powder; a link member which is made from an elastic material and which displaceably couples the first powder transporting cylindrical member and the second powder transporting cylindrical member with each other; and a powder transporting member which is rotatably disposed inside the first powder transporting cylindrical member and the second powder transporting cylindrical member and which transports the powder.

4 Claims, 5 Drawing Sheets

POWDER TRANSPORTING UNIT AND IMAGE FORMING APPARATUS USING THE SAME

CROSS-REFERENCE TO RELATED APPLICATION

This application is based on and claims priority under 35 USC 119 from Japanese Patent Application No. 2010-056168 filed on Mar. 12, 2010.

BACKGROUND

Technical Field

The present invention relates to a powder transporting unit and an image forming apparatus using the same.

SUMMARY

According to an aspect of the invention, a powder transporting unit include:

a first powder transporting cylindrical member in which a powder reception port for receiving a powder from a powder storage container storing the powder is opened in an upper portion of the first powder transporting cylindrical member;

a second powder transporting cylindrical member whose inner diameter is formed to be larger than an inner diameter of the first powder transporting cylindrical member and in which a powder discharge port for discharging the powder transported inside the first powder transporting cylindrical member to a developing unit is opened in a lower portion of the second powder transporting cylindrical member;

a link member which is made from an elastic material and which displaceably couples the first powder transporting cylindrical member and the second powder transporting cylindrical member with each other; and a powder transporting member which is rotatably disposed inside the first powder transporting cylindrical member and the second powder transporting cylindrical member and which transports the powder.

BRIEF DESCRIPTION OF THE DRAWINGS

Exemplary embodiments of the invention will be described in detail based on the following figures, wherein.

DETAILED DESCRIPTION

An exemplary embodiment of the invention will be described below with reference to the drawings.

First Exemplary Embodiment

Figure 2:
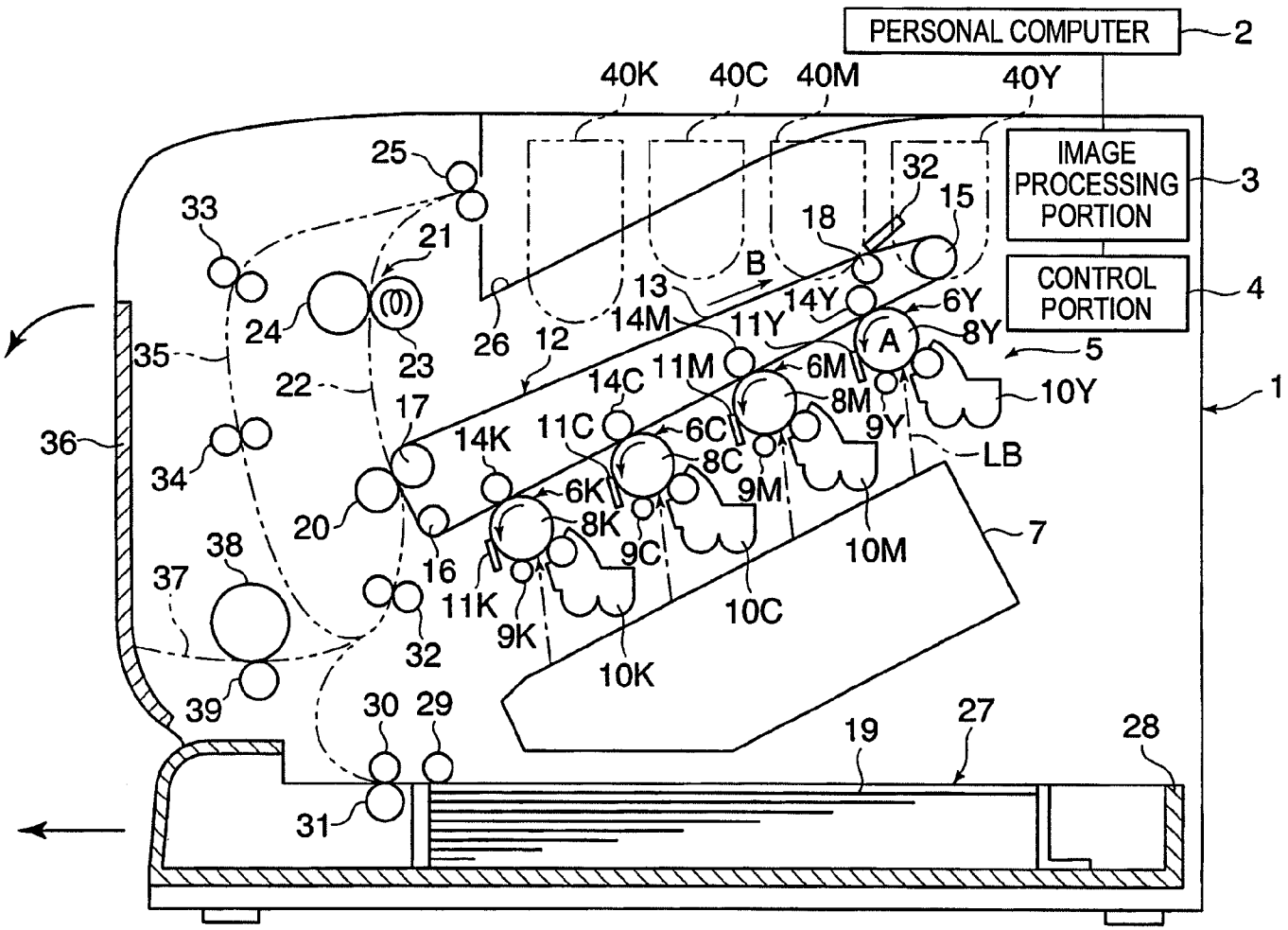
FIG. 2 is a configuration view showing an image forming apparatus using the powder transporting unit according to the first exemplary embodiment of the invention.

FIG. 2 is a configuration view showing a tandem type color printer as an image forming apparatus using a powder transporting unit according to a first exemplary embodiment of the invention.

This color printer outputs a full-color or monochrome image in accordance with image data supplied from a personal computer, a not-shown image reading device or the like, or image data sent through a phone line, a LAN or the like, as shown in FIG. 2.

An image processing portion 3 and a control portion 4 are disposed inside a color printer body 1 as shown in FIG. 2. The image processing portion 3 performs predetermined image processing on image data supplied from a personal computer (PC) 2, a not-shown image reading device or the like, in accordance with necessity. The predetermined image processing includes shading correction, misalignment correction, brightness/color-space conversion, gamma correction, frame erasure, color/movement editing, etc. The control portion 4 controls the operation of the color printer as a whole.

The image data on which the predetermined image processing has been performed by the image processing portion 3 as described above are converted into image data of four colors, that is, yellow (Y), magenta (M), cyan (C) and black (K) by the same image processing portion 3, and outputted as a full-color image or a monochrome image by an image output portion 5 provided inside the color printer body 1 as will be described below.

Inside the color printer body 1, as shown in FIG. 2, four image forming units (image forming portions) 6Y, 6M, 6C and 6K corresponding to yellow (Y), magenta (M), cyan (C) and black (K) are disposed in parallel at regular intervals and inclined at a predetermined angle with respect to a horizontal direction so that the image forming unit 6Y of yellow (Y) which is the first color is the highest in height among all the image forming units and the image forming unit 6K of block (K) which is the last color is the lowest in height among all the image forming units.

Since the four image forming units 6Y, 6M, 6C and 6K of yellow (Y), magenta (M), cyan (C) and black (K) are disposed and inclined at a predetermined angle in this manner, each distance between adjacent ones of the image forming units 6Y, 6M, 6C and 6K may be shortened as compared with the case where the four image forming units 6Y, 6M, 6C and 6K are disposed horizontally. Thus, the color printer body 1 may be reduced in width and made smaller in size.

The four image forming units 6Y, 6M, 6C and 6K have the same configuration fundamentally, except for colors of images to be formed. As shown in FIG. 2, each image forming unit roughly includes a photoconductor drum 8, a primary charging roll 9, an image exposure unit 7, a developing unit 10 and a cleaning unit 11. The photoconductor drum 8 serves as an image retainer, which is rotationally driven at a predetermined speed in a direction indicated by an arrow A by a not-shown driving device. The primary charging roll 9 uniformly charges the surface of the photoconductor drum 8. The image exposure unit 7 exposes the surface of the photoconductor drum 8 with light in accordance with the image data of a predetermined color, so as to form an electrostatic latent image on the surface of the photoconductor drum 8. The developing unit 10 develops the electrostatic latent image formed on the surface of the photoconductor drum 8 with toner of the predetermined color. The cleaning device 11 cleans the surface of the photoconductor drum 8.

For example, a drum formed with a diameter of about 30 mm and coated with a photoconductor layer made from an organic photoconductor (OPC) or the like is used as the photoconductor drum 8, which is rotationally driven at a predetermined speed in a direction indicated by the arrow A by a not-shown driving motor.

For example, a roll-like charger with a core coated with a conductive layer made from synthetic resin, synthetic rubber or the like and adjusted in electric resistance is used as the charging roll 9. A predetermined charging bias is applied to the core of the charging roll 9.

As shown in FIG. 2, the image exposure unit 7 is shared by the four image forming units 6Y, 6M, 6C and 6K. The surfaces of the photoconductor drums 8Y, 8M, 8C and 8K are scanned and irradiated with laser beams LB emitted and deflected in accordance with the image data of the corresponding colors respectively, so that electrostatic latent images may be formed on the surfaces of the photoconductor drums 8Y, 8M, 8C and 8K. Not to say, the image exposure unit 7 does not have to use laser beams. It is a matter of course that an LED array etc. arranged in accordance with the photoconductor drums 8Y, 8M, 8C and 8K may be used as the image exposure unit 7.

Respective color image data are sequentially outputted from the image processing portion 3 to the image exposure unit 7 which is provided to be shared by the image forming units 6Y, 6M, 6C and 6K corresponding to the respective colors, that is, yellow (Y), magenta (M), cyan (C) and black (K). The surfaces of the photoconductor drums 8Y, 8M, 8C and 8K are scanned and exposed with the corresponding laser beams LB which are emitted from the image exposure unit 7 in accordance with the image data, so that electrostatic latent images are formed on the surfaces of the photoconductor drums 8Y, 8M, 8C and 8K in accordance with the image data. The electrostatic latent images formed on the surfaces of the photoconductor drums 8Y, 8M, 8C and 8K are developed as toner images corresponding to the respective colors, that is, yellow (Y), magenta (M), cyan (C) and black (K) by the corresponding developing units 10Y, 10M, 10C and 10K respectively.

The toner images of the respective colors, that is, yellow (Y), magenta (M), cyan (C), and black (K) sequentially formed on the photoconductor drums 8Y, 8M, 8C and 8K of the image forming units 6Y, 6M, 6C and 6K are primarily transferred sequentially to the surface of an intermediate transfer belt 13 by four primary transfer rolls 14Y, 14M, 14C and 14K so as to be superimposed on each other. The transfer belt 13 serves as an intermediate transferor of an intermediate transferor unit 12 disposed and inclined above the image forming units 6Y, 6M, 6C and 6K.

The intermediate transfer belt 13 is an endless belt member which is stretched by plural of rolls. The intermediate transfer belt 13 is disposed to be inclined with respect to the horizontal direction so that a lower running area of the belt member becomes relatively low on the downstream side in its running direction and relatively high on the upstream side likewise.

That is, as shown in FIG. 2, the intermediate transfer belt 13 is stretched with a predetermined tension among a driving roll 15, a driven roll 16, a backing roll 17 of a secondary transfer portion, and a driven roll 18. The driving roll 15 is rotationally driven by a not-shown driving motor which is superior in speed constancy. Thus, by the driving roll 15, the intermediate transfer belt 13 is cyclically driven at a predetermined speed in a direction indicated by an arrow B. For example, an endless belt formed out of a synthetic resin film of polyimide, polyamide-imide or the like with flexibility is used as the intermediate transfer belt 13. The intermediate transfer belt 13 is disposed in contact with the photoconductor drums 8Y, 8M, 8C and 8K of the image forming units 6Y, 6M, 6C and 6K in its lower running area.

As shown in FIG. 2, a secondary transfer roll 20 is disposed on a lower-side end portion of an upper running area of the intermediate transfer belt 13 and is in contact with the surface of the intermediate transfer belt 13 which is stretched by the backing roll 17. The secondary transfer roll 20 serves as a secondary transfer unit by which the toner images primarily transferred onto the intermediate transfer belt 13 may be secondarily transferred onto a recording medium 19.

As shown in FIG. 2, the toner images of the respective colors, that is, yellow (Y), magenta (M), cyan (C) and black (K) transferred onto the intermediate transfer belt 13 so as to be superimposed on each other are secondarily transferred onto the recording sheet 19 in a lump by the secondary transfer roll 20 which is in contact with the backing roll 17 through the intermediate transfer belt 13. The recording sheet 19 serves as a recording medium. The recording sheet 19 on which the toner images of the colors have been transferred is transported to a fixing unit 21 through a sheet transport path 22. The fixing unit 21 is located above the secondary transfer roll 20 in a vertical direction. The secondary transfer roll 20 is in pressure contact with one side of the backing roll 17 through the intermediate transfer belt 13 so that the toner images of the colors may be secondarily transferred in a lump onto the recording sheet 19 which has been transported upward from a lower side in the vertical direction.

For example, a core made from metal such as stainless steel and circumferentially coated with an elastic substance layer of a conductive elastic substance in a predetermined thickness is used as the secondary transfer roll 20. The conductive elastic substance is made from a synthetic rubber material or the like doped with a conductive agent.

The recording sheet 19 on which the toner images of the colors have been transferred is then subjected to a fixing process with heat and pressure by a heating roll 23 and a pressure belt (or pressure roll) 24 in the fixing unit 21. After that, the recording sheet 19 is outputted, with its image surface down, onto an output tray 26 by an output roll 25. The output tray 26 is provided in a top portion of the printer body 1.

As shown in FIG. 2, one recording sheet 19 of a material having a predetermined size is separated from another and fed from a sheet supply tray 28 of a sheet supply unit 27 by a sheet supply roll 29 and a pair of sheet separating rolls 30 and 31, and once transported to a registration roll 32. The sheet supply unit 27 is disposed in a bottom portion of the printer body 1. The recording sheet 19 supplied from the sheet supply tray 28 is then sent out to a secondary transfer position on the intermediate transfer belt 13 by the registration roll 32 which is rotationally driven in sync with the toner images on the intermediate transfer belt 13. In addition to normal paper, cardboard such as coated paper whose front surface or front and back surfaces have been coated may be fed as the recording sheet 19. A photographic image or the like may be outputted on the recording sheet 19 which is made of coated paper.

As shown in FIG. 2, residual toner remaining on the surface of the photoconductor drum 8 which has completed the primary transfer process of the toner image is removed by the cleaning unit 11. Thus, the photoconductor drum 8 is ready for the next image forming process.

On the other hand, as shown in FIG. 2, residual toners and so on remaining on the surface of the intermediate transfer belt 13 which has completed the secondary transfer process of the toner images are removed by a belt cleaning unit 32 which is disposed closely to the upstream side of the driving roll 15. Thus, the intermediate transfer belt 13 is ready for the next image forming process.

Further, to form images on the two sides of the recording sheet 19, the recording sheet 19 where an image has been formed on one side is not outputted directly onto the output tray 26 provided in the top portion of the printer body 1 by the output roll 25. In the state where the rear end of the recording sheet 19 is held by the output roll 25, the output roll 25 is rotated reversely while the sheet transport path is changed over to a two-sided printing transport path 35 running upward. In the two-sided printing transport path 35, transport rolls 33 and 34 are disposed. The recording sheet 19 which has been upside-down is transported to the registration roll 32 again, and another image is formed on the back surface of the recording sheet 19.

In the aforementioned color printer, recording sheets 19 of a material each having a desired size may be fed not only from the sheet supply tray 28 but also from a bypass tray 36 which is provided to be open/closed in the front surface of the printer body 1 illustrated as a left side surface of the printer body 1 in FIG. 2. One of the recording sheets 19 placed on the bypass tray 36 is separated from another and fed through a bypass transport path 37 by a pair of sheet separating transport rolls 38 and 39, and transported to the registration roll 32.

In FIG. 2, the reference numerals 40Y, 40M, 40C and 40K represent toner cartridges supplying powders made from toners of the respective colors or toners of the respective colors and carriers. The respective colors of the toners correspond to the respective colors (i.e. yellow (Y), magenta (M), cyan (C) and black (K)) of the developing units 10Y, 10M, 10C and 10K. In this exemplary embodiment, a powder made from toner and carrier is supplied from each toner cartridge 40Y, 40M, 40C, 40K.

Figure 3:
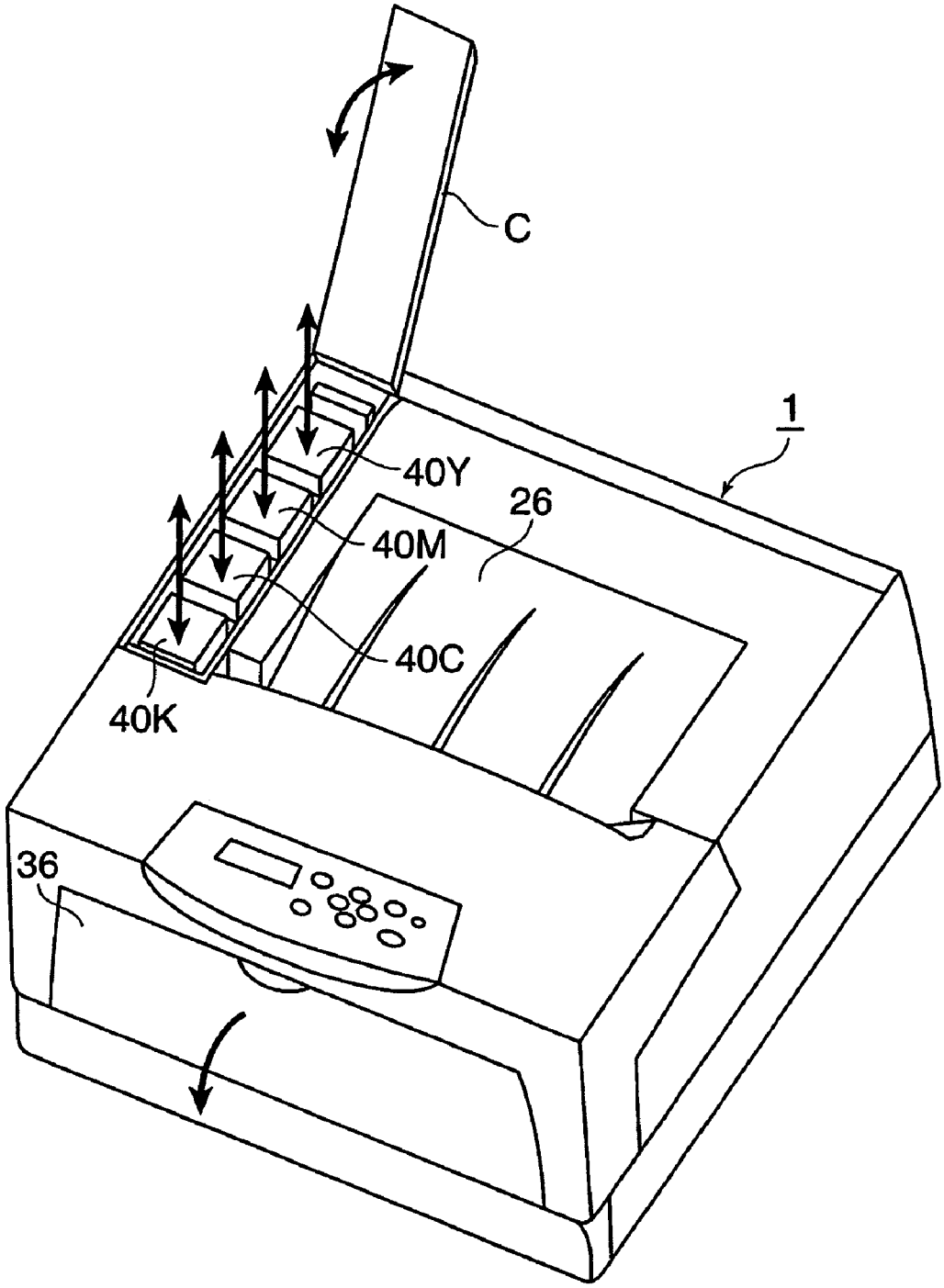
FIG. 3 is an external perspective view of the image forming apparatus using the powder transporting unit according to the first exemplary embodiment of the invention, in which an upper cover of the image forming apparatus is open.

As shown in FIG. 3, the toner cartridges 40Y, 40M, 40C and 40K are received in a cartridge receiving portion of the printer body 1. The cartridge receiving portion is exposed when a top cover C provided rotatably in an upper end surface of the printer body 1 and at a side of the output tray 26 is opened. The toner cartridges 40Y, 40M, 40C and 40K are disposed so that each toner cartridge 40Y, 40M, 40C, 40K may be removed from the printer body 1 and replaced by a new one individually.

Figure 4:
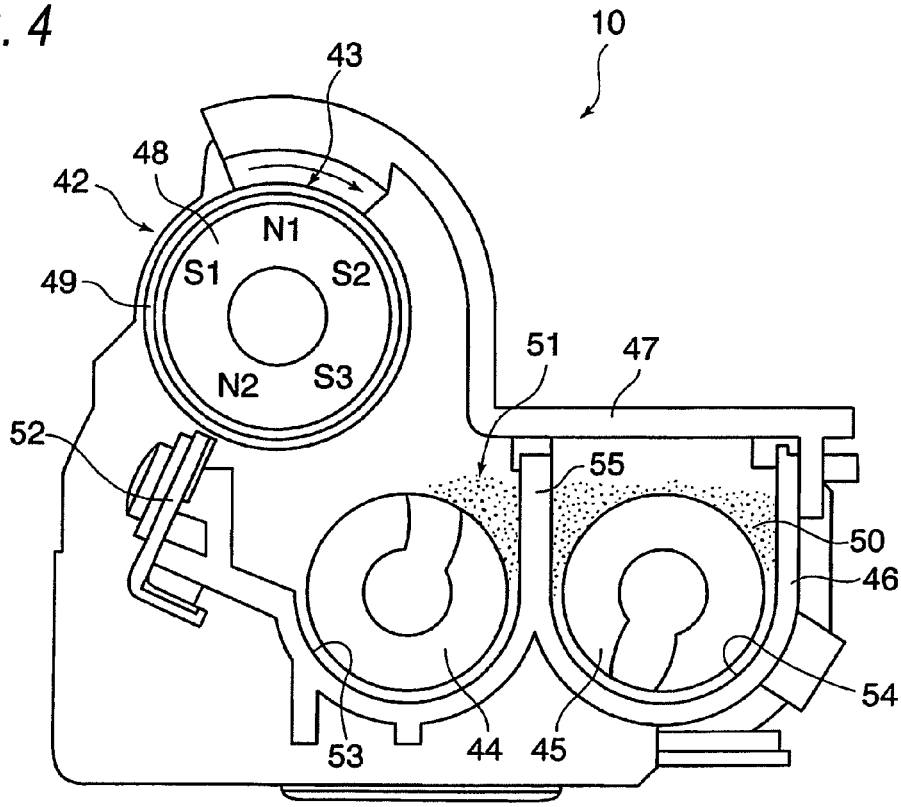
FIG. 4 is a sectional view of a developing unit according to the first exemplary embodiment of the invention.

FIG. 4 is a configuration view showing a developing unit to which a powder including at least toner is supplied from one of the aforementioned toner cartridges.

As shown in FIG. 4, the developing unit 10 roughly has a developing unit body 41, a developing roll 43 and two augers 44 and 45. The developing roll 43 serves as a powder retainer, which is disposed in an opening portion 42 provided in an upper side surface (left side surface in FIG. 4) of the developing unit body 41. The augers 44 and 45 are disposed in parallel on the obliquely lower back side of the developing roll 43. The augers 44 and 45 serve to stir and transport the powder.

The developing unit body 41 includes a lower housing 46 and an upper housing 47. The opening portion 42 is provided in a position corresponding to one side surface of the upper housing 47, while the developing roll 43 serving as a powder retainer is disposed in the opening portion 42. The developing roll 43 includes a magnet roll 48 and a developing sleeve 49. The magnet roll 48 serves as a columnar magnetic substance, which is fixedly disposed inside the developing roll 43. The developing sleeve 49 is disposed on the outer circumference of the magnet roll 48 so as to be rotatable in an arrow direction.

In addition, as shown in FIG. 4, a powder receiving chamber 51 is provided under the developing roll 43. The powder receiving chamber 51 is formed by the lower housing 46 and serves as a space, for example, to receive a two-component powder 50 composed of toner and carrier (magnetic powder). In addition, in the lower housing 46, a powder limiting member 52 is disposed at a predetermined distance from the surface of the developing roll 43 in a position close to the opening portion 42 and corresponding to a transport pole N2 on the rotationally upstream side of the developing roll 43. The powder limiting member 52 limits the amount of the powder 50 to be supplied to the surface of the developing roll 43.

Further, as shown in FIG. 4, inside the lower housing 46, the two-component powder 50 composed of toner and carrier is received, while the first and second stirring/transporting augers 44 and 45 are disposed. The first stirring/transporting auger 44 serves as a first powder stirring/transporting member which transports the powder 50 while stirring the powder 50 to supply the powder 50 to the surface of the developing roll 43. The second stirring/transporting auger 45 serves as a second powder stirring/transporting member which transports the powder 50 while stirring the powder 50. The powder receiving chamber 51 formed inside the lower housing 46 is sectioned into first and second stirring/transporting auger receiving chambers 53 and 54 by a partition 55. The first stirring/transporting auger receiving chamber 53 serves as a first powder stirring/transporting member receiving chamber where the first stirring/transporting auger 44 is received. The second stirring/transporting auger receiving chamber 54 serves as a second powder stirring/transporting member receiving chamber where the second stirring/transporting auger 45 is received.

Figure 5:
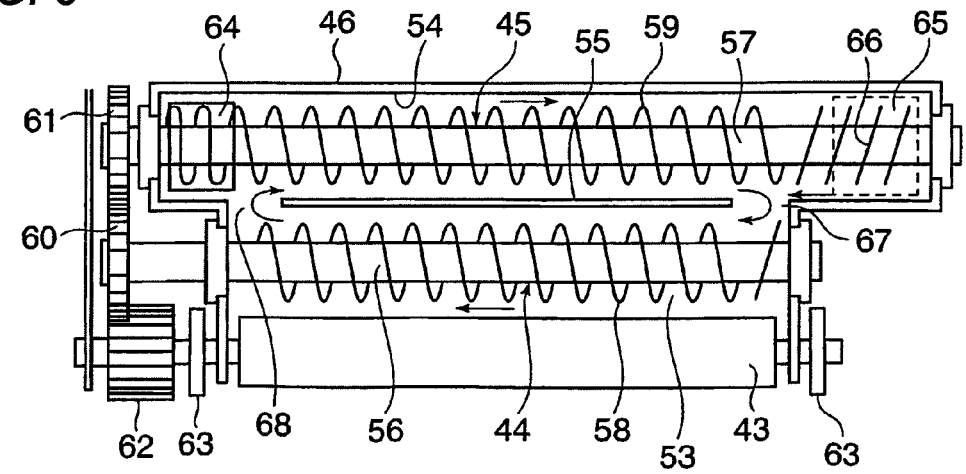
FIG. 5 is a sectional view of the powder transporting unit according to the first exemplary embodiment of the invention.

In addition, as shown in FIG. 5, each first, second stirring/transporting auger 44, 45 includes a rotary shaft 56, 57 formed into a columnar shape and a stirring/transporting blade 58, 59 formed spirally on the outer circumference of the rotary shaft 56, 57. The first and second stirring/transporting augers 44 and 45 are designed to transport the powder 50 in opposite directions to each other while stirring the powder 50.

As shown in FIG. 5, the first and second stirring/transporting augers 44 and 45 are rotationally driven by gears 60 and 61 attached to end portions of the rotary shafts 56 and 57 respectively. In addition, the gear 60 engages with a driving gear 62 provided in an end portion of the developing roll 43. In FIG. 5, the reference numeral 63 represents a tracking roll provided in each end portion of the developing roll 43. The tracking rolls 63 rotate in contact with the surface of the photoconductor drum 8 so that the distance between the developing roll 43 and the surface of the photoconductor drum 8 may be set at a predetermined value.

In addition, in the configuration of the color printer as shown in FIG. 2, when the developing roll 43 etc. of the developing unit 10 is rotationally driven for forming an image, the developing unit 10 moves upward to approach the photoconductor drum 8 due to the rotation moment of the gears transmitting the rotational driving force of the developing roll 43 etc. of the developing unit 10. On that occasion, the distance between the developing roll 43 of the developing unit 10 and the photoconductor drum 8 is set at a predetermined value by the tracking rolls provided in the axially opposite end portions of the developing roll 43.

Further, a supply port 64 is opened in the ceiling surface of one axial end portion of the second stirring/transporting auger 45 as shown in FIG. 5. The powder 50 is supplied to the support port 64 from the toner cartridge 40 (see FIG. 3) by a powder transporting unit which will be described later. In addition, a discharge port 65 is opened in the bottom surface of the other axial end of the second stirring/transporting auger 45. The excessive powder 50 is discharged little by little from the inside of the second stirring/transporting auger receiving chamber 54 to the outside through the discharge port 65.

A limiting auger 66 is provided in the other axial end portion of the second stirring/transporting auger 45 to transport the powder 50 in the opposite direction. The amount of the excessive powder 50 to be discharged from the discharge port 65 is limited to a predetermined slight amount by the limiting auger 66.

As shown in FIG. 5, the partition 55 for partitioning the first stirring/transporting auger receiving chamber 53 and the second stirring/transporting auger receiving chamber 54 is provided inside the developing unit 10. In addition, circulating paths 67 and 68 for circulating the powder 50 between the first stirring/transporting auger receiving chamber 53 and the second stirring/transporting auger receiving chamber 54 are formed in the opposite end portions of the partition 55 respectively.

In the developing unit 10, as shown in FIG. 5, a fresh powder 50 including at least toner (a powder composed of tone and carrier in this exemplary embodiment) is supplied to one axial end portion of the second stirring/transporting auger 45, transported in the axial direction of the second stirring/transporting auger 45 and delivered to the first stirring/transporting auger 44 through the path 67 provided near the other axial end portion of the second stirring/transporting auger 45. While being transported in the axial direction of the first stirring/transporting auger 44, the powder 50 is supplied to the surface of the developing roll 43 and then delivered to the second stirring/transporting auger 45 through the path 68 provided in the axial end portion of the first stirring/transporting auger 44.

On that occasion, a part of the powder 50 delivered from the second stirring/transporting auger 45 to the first stirring/transporting auger 44 through the path 67 is transported to the other axial end portion of the second stirring/transporting auger 45, and discharged little by little to the outside through the discharge port 65 provided in the bottom surface of the axial end portion of the second stirring/transporting auger 45.

Figure 1:
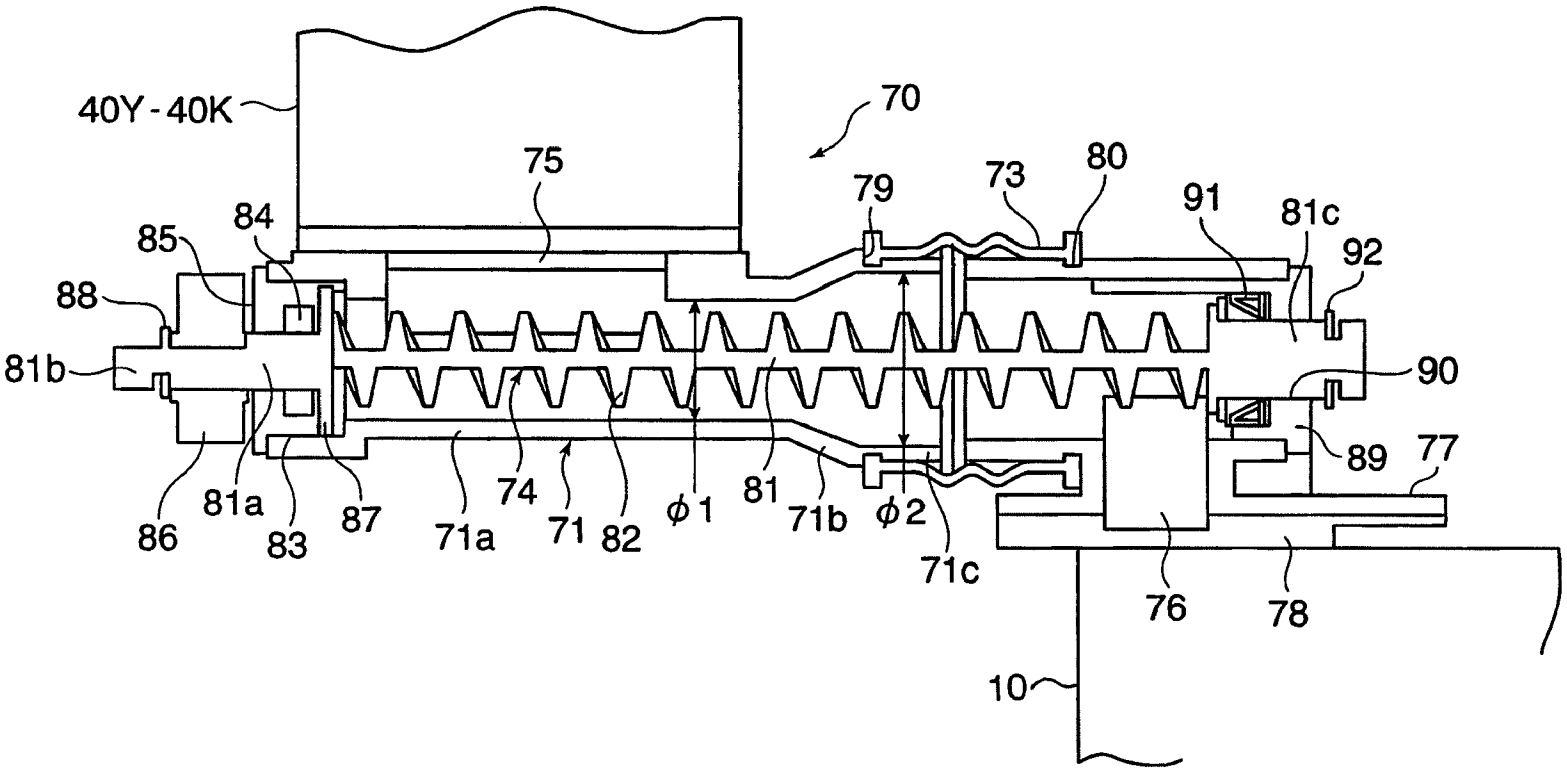
FIG. 1 is a sectional configuration view of a powder transporting unit according to a first exemplary embodiment of the invention.

FIG. 1 is a sectional configuration view showing the powder transporting unit for transporting the powder from the toner cartridge to the developing unit.

As shown in FIG. 1, the powder 50 composed of toner of a corresponding color and carrier is supplied from the toner cartridge 40 to the supply port 64 of the developing unit 10 configured thus. A supply auger serving as a powder stirring/supplying member is rotatably disposed inside the toner cartridge 40. While stirring a powder received inside the toner cartridge 40, the supply auger supplies the powder through a supplement port provided in the lower end portion of the toner cartridge 40.

In addition, as shown in FIG. 1, a powder transporting unit 70 is used to transport the powder from the toner cartridge 40Y, 40M, 40C, 40K to the corresponding developing unit 10Y, 10M, 10C, 10K.

As shown in FIG. 1, the powder transporting unit 70 roughly includes a first powder transporting cylindrical member 71, a second powder transporting cylindrical member 72, a link member 73 and a powder transporting member 74. The first powder transporting cylindrical member 71 is disposed on the toner cartridge 40 side. The second powder transporting cylindrical member 72 is disposed on the developing unit 10 side. The link member 73 couples the first powder transporting cylindrical member 71 and the second powder transporting cylindrical member 72. The powder transporting member 74 is made from a synthetic resin material or the like with flexibility. The powder transporting member 74 is disposed rotatably inside the first powder transporting cylindrical member 71 and the second powder transporting cylindrical member 72.

A shown in FIG. 1, the first powder transporting cylindrical member 71 includes a small-diameter portion 71*a*, an intermediate portion 71*b* and a large-diameter portion 71*c*. The small-diameter portion 71*a* is formed to have a small diameter smaller than the second powder transporting cylindrical member 72. For example, the inner diameter $\phi 1$ of the small-diameter portion 71*a* is about 9 mm. The intermediate portion 71*b* is disposed in an end portion of the small-diameter portion 71*a* on the second powder transporting cylindrical member 72 side. The intermediate portion 71*b* is formed into a conical shape with an inner diameter increasing gradually. The large-diameter portion 71*c* is formed to have a large inner diameter equal to the inner diameter of the second powder transporting cylindrical member 72. The small-diameter portion 71*a* of the first powder transporting cylindrical member 71 is set to be longer than the axial length of the powder reception port through which a powder is received from a toner cartridge. All the powder received through the powder reception port is received in the small-diameter portion 71*a* of the first powder transporting cylindrical member 71. On the other hand, the second powder transporting cylindrical member 72 is formed to have a large diameter larger than the first powder transporting cylindrical member 71. For example, the inner diameter of the second powder transporting cylindrical member 72 is about 13 mm. In addition, the length of the second powder transporting cylindrical member 72 is set to be relatively short. The second powder transporting cylindrical member 72 is made approximately half as long as the first powder transporting cylindrical member 71.

The first and second powder transporting cylindrical members 71 and 72 form a powder transport path connecting the toner cartridge 40 and the developing unit 10 linearly by the shortest distance. The first and second powder transporting cylindrical members 71 and 72 are set to be comparatively short in length to divide the powder transport path substantially into two. Thus, a load on the powder transported from the toner cartridge 40 to the developing unit 10 may be made as small as possible, and the powder transported by the first and second powder transporting cylindrical members 71 and 72 may be prevented from being aggregated.

Further, in the upper portion of the first powder transporting cylindrical member 71, a powder reception port 75 for receiving the powder 50 from the toner cartridge 40 is opened along the small-diameter portion 71*a* of the first powder transporting cylindrical member 71 largely enough to occupy a major part of the length of the small-diameter portion 71*a* of the first powder transporting cylindrical member 71.

In addition, in the lower portion of the forward end portion of the second powder transporting cylindrical member 72, a discharge port 76 for discharging the powder from the second powder transporting cylindrical member 72 to the supply port 64 of the developing unit 10 is formed into a substantially square or rectangular shape corresponding to the planar shape of the supply port 64 of the developing unit 10. The length of the discharge port 76 is formed to be comparatively short in the longitudinal direction of the second powder transporting cylindrical member 72 and to be comparatively long in the circumferential direction of the second powder transporting cylindrical member 72 which is formed to have a comparatively large diameter. In addition, a flange portion 77 to be joined to the supply port 64 of the developing unit 10 is formed integrally with the lower end portion of the discharge port 76 of the second powder transporting cylindrical member 72. In addition, a leakage preventing member 78 for preventing leakage of the powder is interposed between the flange portion 77 and the supply port 64 of the developing unit 10.

Further, as shown in FIG. 1, the first and second powder transporting cylindrical members 71 and 72 are coupled with each other by the link member 73 which is made from an elastic material such as rubber. The link member 73 is formed into bellows, which may absorb the movement (displacement) of the second powder transporting cylindrical member 72 even if at least one of the first and second powder transporting cylindrical members 71 and 72, for example, the second powder transporting cylindrical member 72 on the developing unit 10 side moves vertically due to the driving of the developing unit 10. The link member 73 is mounted with its own elastic deformation force, by which the link member 73 is pressed into concave grooves 79 and 80 provided in the end portion of the large-diameter portion 71*c* of the first powder transporting cylindrical member 71 and the first powder transporting cylindrical member 71 side end portion of the second powder transporting cylindrical member 72 respectively.

In addition, as shown in FIG. 1, the powder transporting member 74 disposed inside the first and second powder transporting cylindrical members 71 and 72 has a rotary shaft 81 and a transporting blade 82. The rotary shaft 81 is rotationally driven. The transporting blade 82 is formed spirally at a predetermined pitch and integrally with the outer circumference of the rotary shaft 81. The powder transporting member 74 is, for example, formed from a synthetic resin material or the like with flexibility. Even if the first and second powder transporting cylindrical members 71 and 72 are vertically displaced from each other, the powder transporting member 74 itself may bend rotatably to absorb the displacement between the first and second powder transporting cylindrical members 71 and 72. The outer diameter of the transporting blade 82 of the powder transporting member 74 is set to be smaller than the inner diameter (bore) of the first powder transporting cylindrical member 71 by a predetermined value, for example, about 1.5 to 2.5 mm or smaller, so as to secure some small clearance relative to the inner diameter of the first powder transporting cylindrical member 71. Thus, the powder may be transported stably and smoothly in the axial direction inside the first powder transporting cylindrical member 71 by the transporting blade 82 of the powder transporting member 74. The transporting blade 82 of the powder transporting member 74 may be designed so that the outer diameter of the transporting blade 82 is set to be larger inside the second powder transporting cylindrical member 72 in order to have a difference between the outer diameter inside the first powder transporting cylindrical member 71 and the outer diameter inside the second powder transporting cylindrical member 72.

As shown in FIG. 1, the shaft member 81 of the powder transporting member 74 is inserted and mounted from an opening portion 83 which is provided in one end portion of the first powder transporting cylindrical member 71. In the opening portion 83 of the first powder transporting cylindrical member 71, an end portion 81*a* of the shaft member 81 of the powder transporting member 74 is rotatably supported by a first cover member 85 provided with a bearing member 84. Further, a driving gear 86 for rotationally driving the powder transporting member 74 is attached to an end portion 81*b* of the shaft member 81 of the powder transporting member 74 protruding from the one end portion of the first powder transporting cylindrical member 71. The reference numeral 87 represents a flange portion which is provided in an end portion of the shaft member 81 of the powder transporting member 74 located in the first powder transporting cylindrical member 71. The reference numeral 88 represents a stopper member.

On the other hand, as shown in FIG. 1, a forward end portion 81*c* of the shaft member 81 of the powder transporting member 74 is formed to have a large diameter in the forward end portion of the second powder transporting cylindrical member 72. The forward end portion 81*c* of the shaft member 81 is inserted into a shaft support hole 90 which is provided in a second cover member 89 mounted on the forward end portion of the second powder transporting cylindrical member 72. In addition, a seal member 91 prevents the forward end portion 81*c* of the shaft member 81 from leaking the powder. The reference numeral 92 represents a stopper member provided in the forward end portion 81*c* of the shaft member 81 of the powder transporting member 74.

In the configuration described above, in the color printer using the powder transporting unit according to the exemplary embodiment, the powder is prevented from being aggregated in the transport path of the powder due to the adhesion of the powder to the inside of the transport path. Thus, the powder may be transported stably.

That is, in the aforementioned color printer, as shown in FIG. 2, electrostatic latent images corresponding to image data are formed on the photoconductor drums 8Y, 8M, 8C and 8K of the image forming units 6Y, 6M, 6C and 6K of yellow (Y), magenta (M), cyan (C) and black (K). The electrostatic latent images formed on the photoconductor drums 8Y, 8M, 8C and 8K are developed into toner images by the developing units 10Y, 10M, 10C and 10K. The toner images of the respective colors, i.e. yellow (Y), magenta (M), cyan (C) and black (K) formed on the photoconductor drums 8Y, 8M, 8C and 8K are transferred onto the intermediate transfer belt 13 so as to be superimposed on each other. Then, the toner images are secondarily transferred onto the recording sheet 19 in a lump, and fixed. Thus, a full-color or monochrome image is formed.

As shown in FIG. 4, toner in the powder 50 stored internally in each developing unit 10Y, 10M, 10C, 10K is consumed when the electrostatic latent image formed on the photoconductor drum 8Y, 8M, 8C, 8K is developed. Because of this consumption of the toner, a powder 100 is supplied from the toner cartridge 40Y, 40M, 40C, 40K to the developing unit 10Y, 10M, 10C, 10K through the powder transporting unit 70 at predetermined timing, as shown in FIG. 1.

In the powder transporting unit 70, as shown in FIG. 1, the powder transporting member 74 is rotationally driven for a period obtained by a predetermined arithmetic operation in accordance with the amount of the powder 100 to be supplied. Thus, the powder 100 discharged from the discharge port of the toner cartridge 40 is supplied to the powder reception port 75 opened in the upper portion of the first powder transporting cylindrical member 71. On that occasion, the inside of the first powder transporting cylindrical member 71 is almost filled with the powder 100 discharged from the toner cartridge 40.

Figure 6:
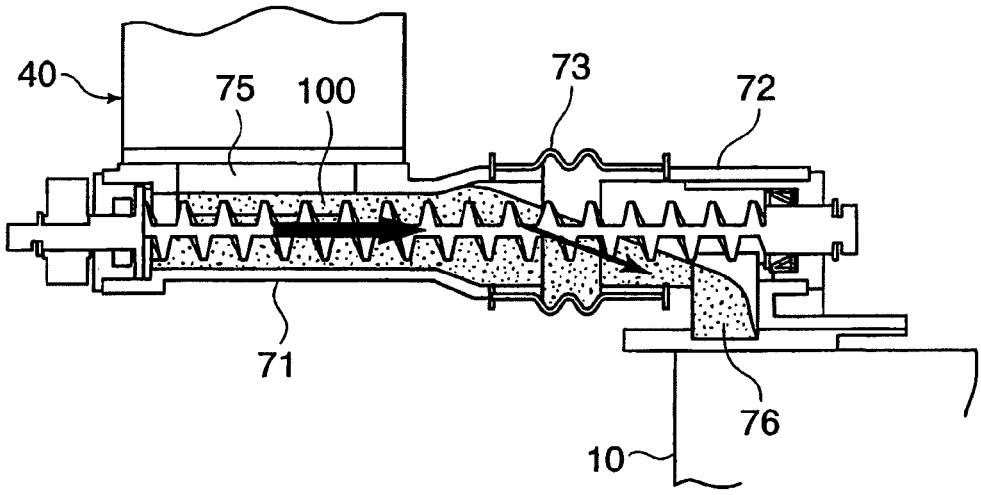
FIG. 6 is a sectional view of the powder transporting unit according to the first exemplary embodiment of the invention.

As shown in FIG. 6, the first powder transporting cylindrical member 71 is set to have a length not shorter than the opening portion of the powder reception port 75. The powder 100 discharged from the discharge port of the toner cartridge 40 is supplied to the first powder transporting cylindrical member 71 through the powder reception port 75, and transported to the second powder transporting cylindrical member 72 by the powder transporting member 74 disposed inside the first powder transporting cylindrical member 71.

On this occasion, the first powder transporting cylindrical member 71 is formed linearly, and the length thereof is set to be comparatively short. In addition, the inner diameter of the second powder transporting cylindrical member 72 is set to be larger than the inner diameter of the first powder transporting cylindrical member 71. Accordingly, the powder 100 transported from the first powder transporting cylindrical member 71 to the second powder transporting cylindrical member 72 does not stay on the way but may be transported to the inside of the second powder transporting cylindrical member 72 surely and stably.

In addition, as shown in FIG. 1, the outer diameter of the transporting blade 82 of the powder transporting member 74 is formed uniformly inside the first and second powder transporting cylindrical members 71 and 72. Accordingly, the powder 100 transported from the first powder transporting cylindrical member 71 to the second powder transporting cylindrical member 72 may stay for some time inside the second powder transporting cylindrical member 72 while being supplied stably to the supply port 64 of the developing unit 10 through the powder discharge port 76 provided in the forward end portion of the second powder transporting cylindrical member 72 by the transport force of the powder transporting member 74.

In the configuration of the aforementioned color printer as shown in FIG. 2, as soon as the developing roll 43 etc. of the developing unit 10 is rotationally driven for forming an image, the developing unit 10 may move to approach the photoconductor drum 8 (i.e. move upward) due to the rotation moment of gears transmitting the rotational driving force of the developing roll 43 etc. of the developing unit 10.

Figure 7:
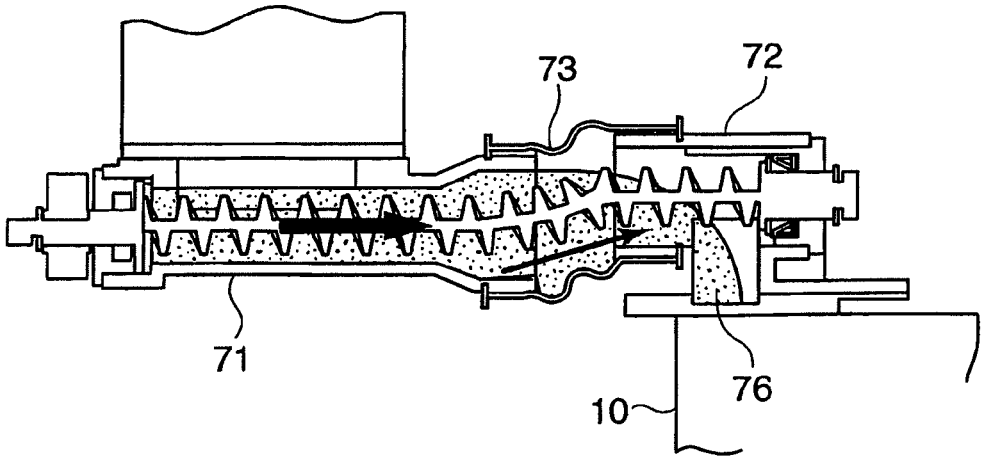
FIG. 7 is a sectional view of the powder transporting unit according to the first exemplary embodiment of the invention.

On this occasion, when the developing unit 10 moves upward to approach the photoconductor drum 8 as soon as the developing roll 43 etc. of the developing unit 10 is rotationally driven for forming an image as shown in FIG. 7, the second powder transporting cylindrical member 72 in the powder transporting unit 70 moves upward together with the developing unit 10 due to the elastic deformation of the link member 73 made from an elastic material. In this manner, the developing unit 10 moves when the developing unit 10 is driven. Accordingly, when the developing unit 10 is driven and rested alternately and repeatedly, the powder transporting member 74 and the second powder transporting cylindrical member 72 move up and down. Thus, the powder may be prevented from adhering to the inside of the second powder transporting cylindrical member 72.

When the developing unit 10 moves upward, the inner wall (bottom wall) of the second powder transporting cylindrical member 72 may be higher than the inner wall (bottom surface) of the first powder transporting cylindrical member 71, as shown in FIG. 7. Even in this case, the inner wall (ceiling surface) of the first powder transporting cylindrical member 71 is still higher than the inner wall (bottom wall) of the second powder transporting cylindrical member 72 so that the powder 100 may be transported stably from the first powder transporting cylindrical member 71 into the second powder transporting cylindrical member 72 by the transporting operation of the powder transporting member 74. Thus, the powder 100 may be stably supplied to the supply port 64 of the developing unit 10 through the powder discharge port 76 provided in the forward end portion of the second powder transporting cylindrical member 72. Further, when the developing unit 10 is being driven, the vibration of the developing unit 10 is propagated to the second powder transporting cylindrical member 72 and the powder transporting member 74 to suppress the adhesion of the powder.

In this manner, in the color printer using the powder transporting unit 70 according to the exemplary embodiment, the powder 100 may be prevented from being aggregated in the transport path of the powder 100 due to the adhesion of the powder 100 to the inside of the transport path. Thus, the powder 100 may be transported stably.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following s and their equivalents.

What is claimed is:

1. A powder transporting unit comprising:

a first powder transporting cylindrical member in which a powder reception port for receiving a powder from a powder storage container storing the powder is opened in an upper portion of the first powder transporting cylindrical member;

a second powder transporting cylindrical member whose inner diameter is formed to be larger than an inner diameter of the first powder transporting cylindrical member and in which a powder discharge port for discharging the powder transported inside the first powder transporting cylindrical member to a developing unit is opened in a lower portion of the second powder transporting cylindrical member;

a link member which is made from an elastic material and which displaceably couples the first powder transporting cylindrical member and the second powder transporting cylindrical member with each other; and a powder transporting member which is rotatably disposed inside the first powder transporting cylindrical member and the second powder transporting cylindrical member and which transports the powder.

2. A powder transporting unit according to claim 1, wherein a difference between the inner diameter of the first powder transporting cylindrical member and an outer diameter of the powder transporting member is set to be not larger than a predetermined value.

3. A powder transporting unit according to claim 1, wherein the second powder transporting cylindrical member moves upward together with the developing unit when the powder transporting member is rotating.

4. An image forming apparatus comprising:

an image retainer having a surface on which an electrostatic latent image is formed;

a developing unit which develops the electrostatic latent image formed on the surface of the image retainer with a powder containing at least toner;

a powder storage container which stores a powder to be supplied to the developing unit; and a powder transporting unit which transports the powder from the powder storage container to the developing unit; wherein:

a powder transporting unit according to claim 1 is used as the powder transporting unit.

* * * * *